US005092464A

United States Patent [19]

Taylor et al.

[11] Patent Number: 5,092,464

[45] Date of Patent: Mar. 3, 1992

[54] COIL TRANSPORTING DEVICE

[75] Inventors: Charles E. Taylor, Knoxville; Ray T. Rucker, Maryville; Andrew G. Chambers, Jr., Alcoa, all of Tenn.

[73] Assignee: Aluminum Company of America, Pittsburgh, Pa.

[21] Appl. No.: 686,014

[22] Filed: Apr. 12, 1991

Related U.S. Application Data

[63] Continuation of Ser. No. 481,901, Feb. 20, 1990, abandoned.

[51] Int. Cl.[5] ..... B65D 85/66

[52] U.S. Cl. ..... 206/408; 206/386; 206/415; 206/493

[58] Field of Search ..... 206/386, 389, 391, 392, 206/393, 394, 408, 413, 415, 493; 108/55.1, 55.3, 56.3

[56] References Cited

U.S. PATENT DOCUMENTS

| | | | |
|---|---|---|---|
| Re. 32,530 | 10/1987 | Cantey, Jr. | 206/392 |
| 3,094,211 | 6/1963 | Bender | 206/392 |
| 3,335,858 | 8/1967 | Sibille | 206/65 |
| 3,730,340 | 5/1973 | Neubert, nee Preischl | 206/65 Y |
| 3,946,866 | 3/1976 | Turnage | 206/392 |
| 4,042,108 | 8/1977 | Brethauer | 206/493 |
| 4,202,448 | 5/1980 | Jaeger et al. | 206/392 |
| 4,407,413 | 10/1983 | Jansson | 206/493 |
| 4,482,051 | 11/1984 | Cantey, Jr. | 206/391 |
| 4,516,677 | 5/1985 | Rowland et al. | 108/55.3 |
| 4,580,680 | 4/1986 | Wind | 206/386 |
| 4,826,008 | 5/1989 | Cloosterman | 206/413 |
| 4,890,743 | 1/1990 | Powel et al. | 206/392 |

FOREIGN PATENT DOCUMENTS

| | | | |
|---|---|---|---|
| 1330029 | 8/1987 | U.S.S.R. | 206/386 |

*Primary Examiner*—David T. Fidei
*Attorney, Agent, or Firm*—Gary P. Topolosky

[57] ABSTRACT

A device for centering a coil of heavy material onto a transporting skid or pallet having intersecting supports, said device comprising a body with top and base portions, the top portion having downwardly diverging sides and a lower section adapted for seating in the core of a coil loaded onto said device. The base portion has a first pair of diametrically opposed notches for receiving a first skid support while a second pair of diametrically opposed notches receives a second skid support angularly disposed from the first support. In one embodiment, the first notch pairs protrude from outwardly extending flanges and more deeply into the base portion than the second notch pair to accommodate platforms having first skid supports which extend over their second skid supports.

22 Claims, 4 Drawing Sheets

COIL TRANSPORTING DEVICE

This application is a continuation of application Ser. No. 07/481,901, filed Feb. 20, 1990 now abandoned.

FIELD OF THE INVENTION

This invention relates to devices for transporting coils of heavy material on skids or pallets having intersecting supports. The invention further relates to devices for centering heavy metal coils on such skids or pallets. After coils are loaded on such devices, the invention restricts movement of the coils on their skids during shipping or transport.

TECHNOLOGY REVIEW

Many articles of commerce, especially those produced in continuous or semicontinuous processes, are wound in coils for easier storage and/or shipping. In metals manufacturing, continuous sheet and wire, even rod products, are commonly wrapped or coiled after production. Once wound, rolls of paper, plastic sheet, or individual coils of steel, aluminum and other metals are downloaded on a wooden skid, pallet or platform. To prevent the lateral shifting of these coils on said platform, it is generally known to affix a straight-sided plug to the platform before loading the coil thereon. Typically, these plugs are made of wood and nailed or bolted directly to the top of each skid or pallet. The assembly and attachment of a new plug for every pallet is a rather labor-intensive, time-consuming chore, however. Following transport and metal coil removal, the stacking of multiple platforms for reuse is hindered by permanently affixed plugs. In some instances, such plugs may be disconnected from their skids by the materials manufacturer, transporter or ultimate customer.

In industries where multiple coils of light materials are shipped on a common pallet, still other transporting devices have been developed. Such devices may often store materials on multiple platform layers as well. U.S. Pat. No, 3,335,858, for example, discloses a device for packing elongated objects (such as cones, spools, etc.) having textile threads loaded thereon. The device includes a centering element having an annular base with substantially the same thickness as the longitudinal and transverse bars connected thereto. The yarn bobbin transporting device of U.S. Pat. No. 3,730,340, on the other hand, comprises a top and bottom part, each having four axial slots offset by 90° for locking about the intersecting rods of its pallet. In U.S. Pat. No. 4,202,448, slots extend into plate-like tray and combine with resilient jaw pairs to embrace the rod-like extensions comprising its pallet. The pallet shown in Reissue U.S. Pat. No. 32,530 includes an article locator at the end of each support member. Such locators may be used to interconnect multiple layers of wound yarn bobbins for shipment.

SUMMARY OF THE INVENTION

It is a principal objective of this invention to provide a coil transporting device which prevents the lateral shifting of heavy coils on their shipping platforms during transport. It is another objective to provide a coil transporting device which does not require fixed attachment to a skid, pallet or the like through bolting, nailing or other means. For that matter, a principal objective of this invention is to provide a coil centering device which removably mounts or attaches to a transporting platform by locking on the platform's intersecting supports. It is another objective to provide inexpensive coil centering means which facilitate efficient disconnection from a skid, reuse of both skid and device, and easier skid/device stacking when not in use.

It is another principal objective of this invention to provide a coil centering device with a dome-shaped or frustoconical cross-section. Such shapes allow for easier coil loading by adjusting for coil position when a coil core is not centered directly over the device during loading. With devices made from soft, pliable materials such as plastic or foam rubber, less damage to the lower coil edges is likely to result with the invention. It is another objective to provide a coil centering device with a detachable top portion for accommodating coil cores of different diameters. It is yet another objective to provide a heavy coil transporting device made from softer, more pliable materials than those used to make current pallet plugs.

In accordance with the foregoing objectives and other advantages, this invention consists of a device comprising a body including both top and base portions, the top portion having a downwardly diverging section and lower section adapted for seating in the coil's axial core. The body's base portion includes a first pair of diametrically opposed notches for receiving a first skid support while a second pair of notches receives a second skid support angularly disposed from the first support. In preferred embodiments, the first notch pairs protrude further into the base portion and toward the top portion than the second notch pair. This allows the invention to facilitate most platforms having a first skid support that extends over as well as at an angle relative to the second skid support. In still other embodiments, the second notch pairs protrude into a pair of diametrically opposed flanges that extend outwardly from the base portion. Such flanges may be connected to the base with one or more wing-like supports.

BRIEF DESCRIPTION OF THE DRAWINGS

Other aspects, objectives and advantages of this invention will be made clearer from the following detailed description of preferred embodiments made with reference to the drawings in which.

DETAILED DESCRIPTION OF THE PREFERRED EMBODIMENTS

Figure 1:
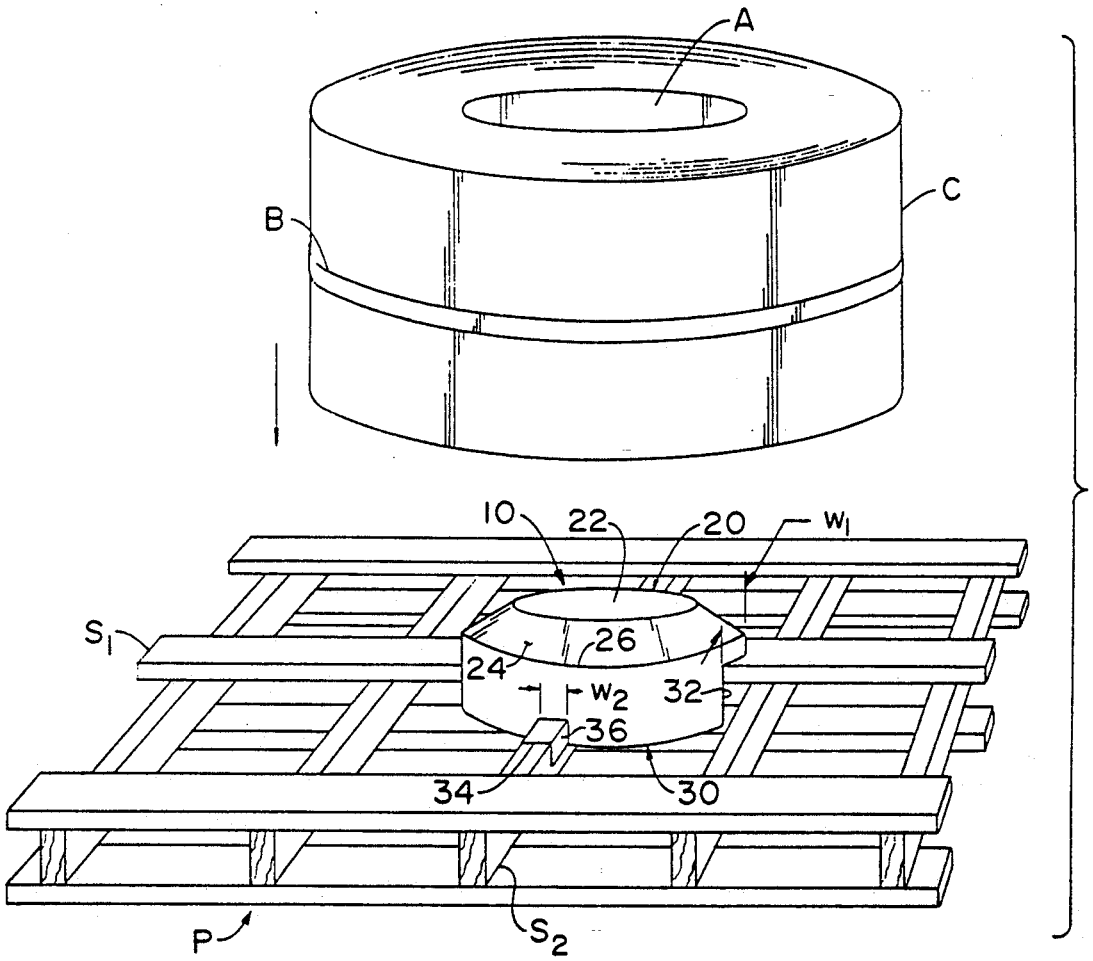
FIG. 1 is a perspective view of a heavy coil being loaded onto one embodiment of device positioned on the intersecting supports of a skid/pallet.
Figure 2:
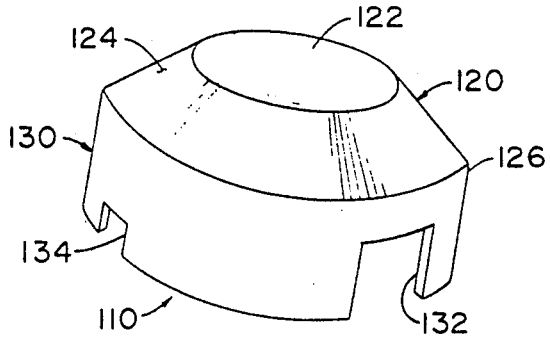
FIG. 2 is a perspective view of a first alternative embodiment.
Figure 3:
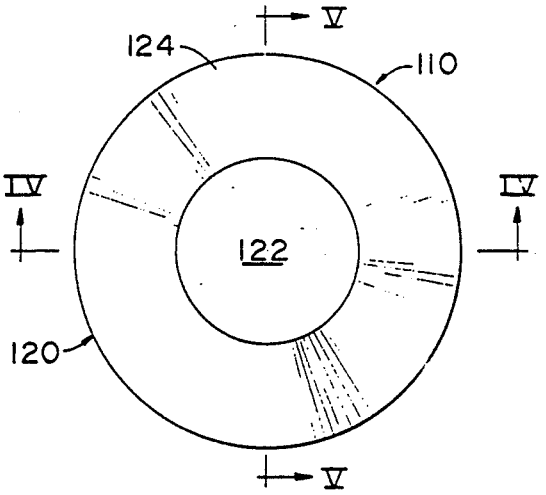
FIG. 3 is a top view of the device shown in FIG. 2.

Referring to FIG. 1, there is shown a heavy coil C surrounded by wrapping band B for lowering onto a device positioned on the intersecting supports $S_1$, $S_2$ of pallet or platform P. For illustration purposes, means for loading coil C onto this improved transporting device have been omitted from FIG. 1 as they are not critical to the invention. Depending on the material and size and weight of coil being loaded, such means may include an overhead crane, core expansion plugs, core and outer coil circumference grippers/pinchers, a fork-lift, or combinations thereof. Many of these known loading means make use of the void that extends vertically through the coil's center or its axial core A.

The device shown in FIG. 1 comprises a body, generally 10, having both top 20 and base portions 30. The top portion includes a substantially planar region 22 with a continuous, annular periphery or downwardly diverging section 24. Together, planar section 22 and diverging section 24 provide the top portion 20 of body 10 with a substantially frustoconical cross-section. Top portion 20 further includes a lower section 26 adapted for seating in the axial core A of coil C. For a better core fit and minimized vertical movement of the coil loaded onto body 10, the diameter of lower section 26 should approximate, or approach but never exceed, the diameter of axial core A.

The base portion 30 of body 10 includes a first pair of diametrically opposed notches 32 (only one shown) for receiving or resting on first skid support $S_1$. A second pair of diametrically opposed notches 34 (only one shown) protrudes upwardly from a pair of outwardly extending, diametrically opposed flanges 36. Together, notch 34 and flange 36 receive a second skid support $S_2$ angularly disposed from first support $S_1$.

Most transporting skids, pallets or platform P typically include supports consisting of wooden 2×4's, though other sizes of wood or planks of other materials such as steel, aluminum, even composites, may be substituted therefor. The representative platform P of FIG. 1 includes both longitudinally and latitudinally extending supports. Although these supports extend normal to one another, it is to be understood that this invention may also be used to transport coils on skids/pallets with supports that intersect at other than right angles. For ease of construction, first skid supports $S_1$ typically extend over and across the second skid supports $S_2$ of platform P. To accommodate this configuration, it is preferred that first notch pair 32 protrude more deeply into base portion 30, or further toward top portion 20, than second notch pair 34.

The representative platform P of FIG. 1 is arranged with a first skid support $S_1$ laid flat over the short edges of several second supports $S_2$. To better lock onto such a skid support arrangement, it is preferred that first notch pair 32 have a larger width $w_1$ than the width $w_2$ of second notch pair 34. First notch 32 may then surround the wider, flat side of first support $S_1$ while narrower second notch 34 cradles the thin edge of second support $S_2$.

In preferred embodiments, base portion 30 and flanges 36 of body 10 are integrally formed, typically from a thermosetting resin such as polyethylene or the like. The coil transporting device of FIG. 1 includes a body with top and base portions formed in one piece from the same soft polymer resin. This device then includes a flexible, cushioned section 24 which reduces the likelihood of damaging the lower edges of a coil whose axial core is not centered directly over body 10 during loading. It is to be understood, however, that while less rigid resins are preferred, the device (or certain portions thereof) may also be made from such other materials as wood, foam rubber, metals and/or composites. Even greater weight savings may be achieved with a hollow body 10, or at least hollow base portion 30 depending on construction material selected and degree of rigidity desired for a particular device.

Figure 4:
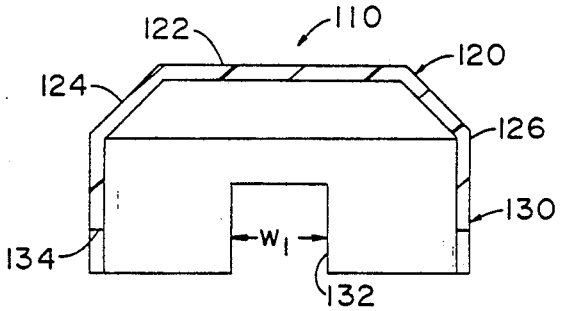
FIG. 4 is a sectional view taken along lines IV—IV of FIG. 3.
Figure 5:
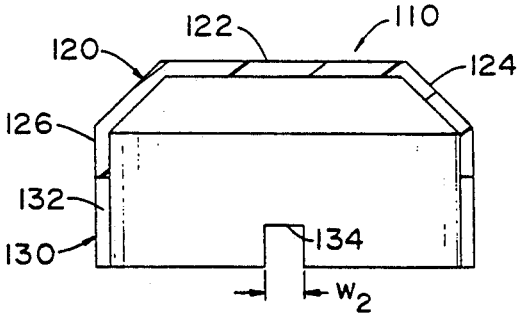
FIG. 5 is a sectional view taken along lines V—V of FIG. 3.

For other embodiments of this invention, substantially similar parts will be correspondingly numbered in the next hundred series. Hence, the first alternative embodiment, shown in FIGS. 2 through 5, includes a hollow body 110 with top portion 120 and bottom portion 130. Like the prior embodiment (FIG. 1), top portion 120 includes a flat, planar region 122 and downwardly diverging section 124 therefrom. The substantially cylindrical lower edge (section 126) of top portion 120 then proceeds directly into a bottom portion 130 having both first notch pairs 132 and second notch pairs 134. The second notch pairs of this embodiment protrude directly into the body and toward top portion 120, rather than upwardly from any outwardly extending flanges. Sectional views of this embodiment (FIGS. 4 and 5) also illustrate the preferred disparities between heights and widths of the first and second notch pairs.

Figure 6:
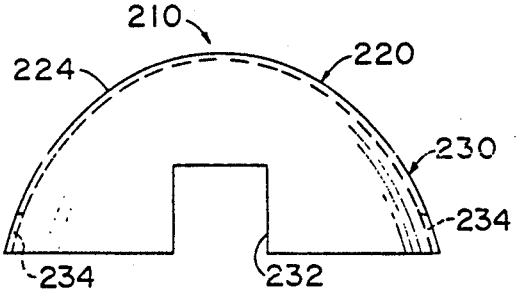
FIG. 6 is a side view of a second alternative embodiment.

In FIG. 6, a second embodiment of the invention is shown having a substantially dome-shaped cross section. As such, top portion 220 of body 210 has no equivalent planar region while its lower section 226 continuously diverges downward, even through most of bottom portion 230 where a first notch pair 232 is visible while both second notch pairs 234 are outlined in dashed lines.

Figure 7:
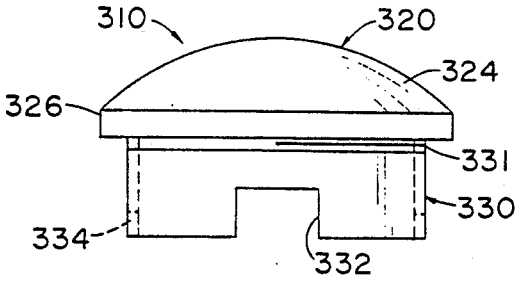
FIG. 7 is a side view of a third alternative embodiment.

The third embodiment shown in FIG. 7 includes a top portion 320 which removably attaches to base portion 330 of body 310. Base portion 330 is specifically provided with a threaded region 331 for accommodating various top portions which may differ in the diameter of their lower sections 326 depending on the diameter of the axial core to be loaded. Still other known or subsequently developed means for interconnecting top and base portions, such as hooks, clips or the like are also anticipated by this invention.

Figure 8:
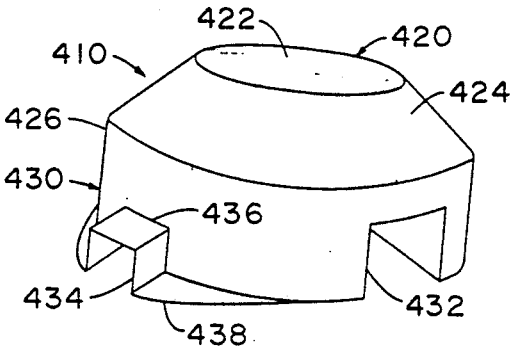
FIG. 8 is a perspective view of a fourth alternative embodiment.
Figure 9:
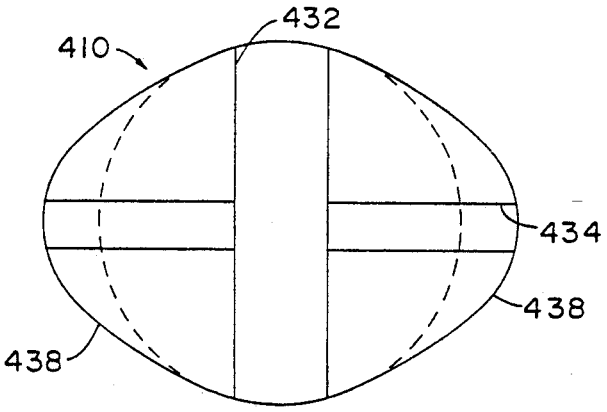
FIG. 9 is a bottom view of the device shown in FIG. 8.
Figure 10:
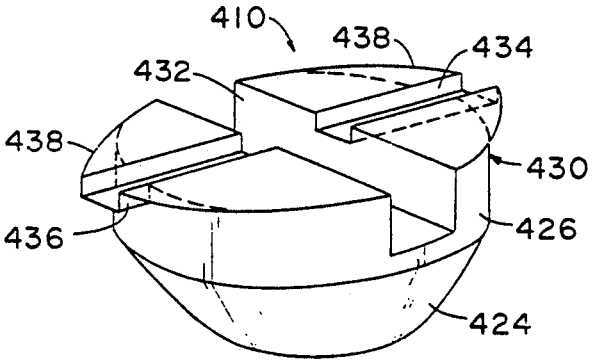
FIG. 10 is a perspective view of the bottom to the FIG. 8 device.

In FIGS. 8 through 10, a fourth embodiment of coil transporting device includes first and second notches that extend through a solid (rather than hollow) base portion 430 to form first channel 432 and second channel 434. This embodiment is particularly suited for bodies 410 made from foam rubber or other readily injectable/pourable materials. This embodiment further includes the addition of support wings 438 on opposing sides of flange 436. Such wings (outlined by dashes in FIGS. 9 and 10) enhance device rigidity while resisting those stresses imparted against the flange sidewalls during rotational shifting of the device in coil loading and/or transport.

Figure 11:
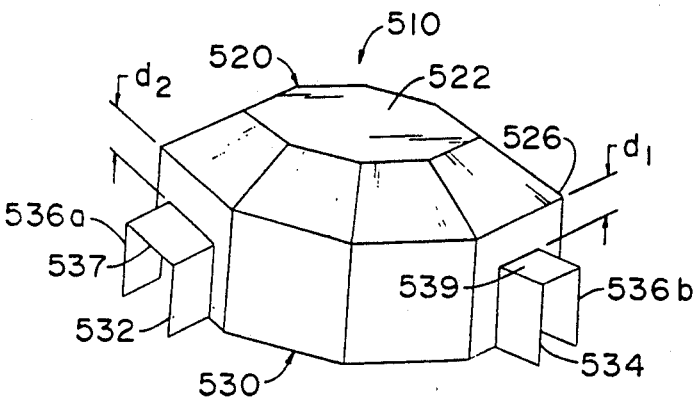
FIG. 11 is a perspective view of a fifth alternative embodiment.
Figure 12:
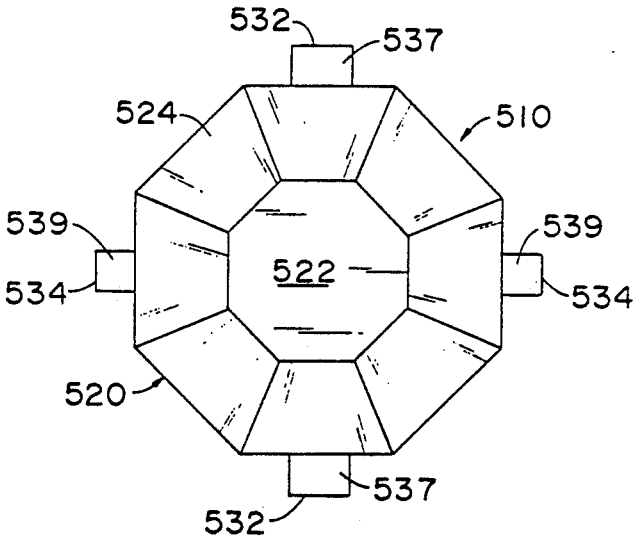
FIG. 12 is a top view of the device shown in FIG. 11.

FIGS. 11 and 12 address yet another embodiment wherein both top portion 520 and base portion 530 consist of a plurality of polygonal sections with the widest spacing between diametrically opposed sections approximating the coil's axial core diameter. In this embodiment, both first notch pair 532 and second notch pair 534 protrude upwardly from outwardly extending flanges 536*a* and *b*, respectively. Since first notch flange 536*a* includes a top shield 537, flange 536*b* must include a shield spacer region 539 so that the top of flange 536*b* extends the same distance $d_1$ from lower section 526 as flange 536*a* from section 526, or $d_2$. When a coil of heavy material is loaded onto such a device, its lower edges will rest more evenly on top shield pairs 537 and spacer pairs 539. Should this device be used to transport coils on a skid whose intersecting supports run perpendicular without passing over one another, the spacer pairs 539 will only need to be as thick as top shields 537.

In a method for transporting heavy coils of material using a pallet having intersecting supports, the improvement comprises: providing one of the aforementioned devices; positioning this device on the intersecting supports of said pallet; and loading the coil onto said device. This device is easily positioned by merely aligning it so that its first notch pairs rest on a first pallet support while its second notch pairs rest on a second pallet support. Should more permanent attachment be desired, the invention may be glued, nailed, snapped or otherwise secured to the intersecting supports of a given shipping platform.

Having described the presently preferred embodiments, it is to be understood that the invention may be otherwise embodied within the scope of the appended claims.

What is claimed is:

1. A device for seating on the intersecting supports of a transporting skid and restricting the movement of a heavy coil disposed on said skid, said device comprising:

a body including top and base portions, said top portion having a downwardly diverging section adapted for seating in an axial core of the coil, said base portion having a first pair of diametrically opposed notches for receiving a first skid support, and a second pair of diametrically opposed notches for receiving a second skid support disposed below and at an angle relative to the first skid support, said first notch pair extending more deeply into the base portion than said second notch pair so that the innermost edges of both notch pairs will be adjacent the upper surfaces of the skid supports when said skid supports are disposed on said notch pairs, and said base portion being sized, at least downwardly to the first notch pair, smaller than the axial core so that the coil will be supported substantially on said skid supports.

2. A device as set forth in claim 1 wherein the first and second notch pairs are generally rectangularly-shaped.

3. A device as set forth in claim 1 wherein the first notch pair has a larger width than the second notch pair.

4. A device as set forth in claim 1 wherein a pair of flanges extend diametrically outwardly from the base portion to form at least a portion of one notch pair.

5. A device as set forth in claim 4 wherein the base portion and flanges are integrally formed.

6. A device as set forth in claim 1 wherein the top portion removably attaches to the base portion.

7. A device as set forth in claim 1 wherein the top and base portions are integrally formed from a polymer resin.

8. A device as set forth in claim 1 wherein the top or base portion is molded from polyethylene.

9. A device as set forth in claim 1 wherein the lower section of the top portion is substantially cylindrical.

10. A device as set forth in claim 1 wherein the base portion is substantially hollow.

11. A device for centering a heavy coil of material on a shipping pallet having a plurality of intersecting supports, said device adapted for seating on said pallet and for being removable from said pallet by lifting when not in use, said device comprising:

a body including top and base portions, said top portion having a downwardly diverging section for disposition in an axial core of the coil, and said base portion having: a first pair of diametrically opposed notches for receiving a first pallet support; and a second pair of diametrically opposed notches for receiving a second pallet support disposed below and at an angle relative to the first pallet support, said base portion being sized, at least downwardly to the first notch pair, smaller than the axial core and said first notch pair extending further into the body than the second notch pair so that when said device is seated on and substantially supported by said pallet, said notch pairs will seat over said pallet supports and substantially preclude the coil from moving on said pallet.

12. A device as set forth in claim 11 wherein the first and second notch pairs are generally rectangularly-shaped.

13. A device as set forth in claim 11 wherein a pair of flanges extend diametrically outwardly from the base portion to form at least a portion of the second notch pair.

14. A device as set forth in claim 13 wherein the base portion and flanges are integrally formed from a thermosetting resin.

15. A removably-mounted device for centering a single, heavy coil on a shipping pallet having intersecting supports, said device comprising:

a body including top and base portions, said top portion being substantially frustoconical and adapted for seating in an axial core extending vertically through the coil disposed on said pallet, said base portion having a first pair of generally rectangularly-shaped, diametrically opposed notches for positioning on a first pallet support and a second pair of generally rectangularly-shaped, diametrically opposed notches for positioning on a second pallet support disposed below and normal to the first pallet support, said base portion being sized, at least downwardly to the first notch pair, smaller than the axial core and said first notch pair protruding more deeply into the body than said second notch pair so that the innermost edges of both notch pairs will be adjacent upper surfaces of the pallet supports when said notch pairs are positioned on said pallet supports thereby reducing rocking of the coil substantially supported by said pallet.

16. A device as set forth in claim 15 wherein the top and base portions are integrally formed from a thermosetting resin.

17. A device as set forth in claim 15 wherein said second notch pair protrudes upwardly into a flange that extends diametrically outwardly from the base portion.

18. A device as set forth in claim 17 wherein said flanges connect to said base portion through one or more support wings.

19. A device as set forth in claim 11 wherein said top portion is substantially closed.

20. A device as set forth in claim 11 wherein said top potion is substantially dome-shaped.

21. A device as set forth in claim 11 wherein said top portion is substantially frustoconical.

22. A device as set forth in claim 15 wherein said plastic body is substantially hollow.

* * * * *